US009087462B1

(12) United States Patent
Gallus

(10) Patent No.: US 9,087,462 B1
(45) Date of Patent: Jul. 21, 2015

(54) EASY ATTACH/DETACH FLAG MOUNT

(75) Inventor: Mark Gallus, Antigo, WI (US)

(73) Assignee: SSP Flags Inc., Antigo, WI (US)

( * ) Notice: Subject to any disclaimer, the term of this patent is extended or adjusted under 35 U.S.C. 154(b) by 393 days.

(21) Appl. No.: 13/463,094

(22) Filed: May 3, 2012

Related U.S. Application Data

(60) Provisional application No. 61/482,906, filed on May 5, 2011.

(51) Int. Cl.
*G09F 17/00* (2006.01)

(52) U.S. Cl.
CPC ..... *G09F 17/00* (2013.01); *G09F 2017/0075* (2013.01)

(58) Field of Classification Search
CPC . G09F 17/00; G09F 17/0091; G09F 2017/00; G09F 2017/0066; G09F 2017/0075
USPC ..... 116/28 R, 173, 209, DIG. 24; 24/3.2, 24/16 R, 17 A; 33/373; 40/591, 597, 40/607.02, 607.1, 607.11, 607.12, 660; 224/42.39, 200, 493, 901.2, 901.4, 224/901.6, 901.8; 248/219.4, 538, 539; D11/166, 182
See application file for complete search history.

(56) References Cited

U.S. PATENT DOCUMENTS

| | | | | | |
|---|---|---|---|---|---|
| 1,677,379 | A | * | 7/1928 | Ames | 248/538 |
| 1,743,442 | A | * | 1/1930 | Fanslau et al. | 248/537 |
| D133,859 | S | * | 9/1942 | Gass | D11/182 |
| 2,302,300 | A | * | 11/1942 | Davies | 224/559 |
| 2,462,442 | A | * | 2/1949 | Wallace | 248/538 |
| 3,797,450 | A | * | 3/1974 | Frisbee | 116/28 R |
| 3,920,207 | A | * | 11/1975 | Adamaitis | 248/538 |
| D246,013 | S | * | 10/1977 | Morris et al. | D3/229 |
| 4,667,428 | A | * | 5/1987 | Elmer | 40/592 |
| 5,042,418 | A | * | 8/1991 | Hoover et al. | 116/173 |
| 5,062,380 | A | * | 11/1991 | Chestnutt | 116/28 R |
| 5,114,369 | A | * | 5/1992 | Coffey | 441/11 |
| 5,214,874 | A | * | 6/1993 | Faulkner | 43/25.2 |

(Continued)

FOREIGN PATENT DOCUMENTS

KR 2006005707 A * 1/2006 ..... G06F 17/00

OTHER PUBLICATIONS 2002 promotional flyer of SSP Flags Inc., for Fixed Attach Flag Mount Base.

(Continued)

*Primary Examiner* — R. A. Smith
(74) *Attorney, Agent, or Firm* — Boardman & Clark LLP

(57) ABSTRACT

An exemplary flag mount bracket having a body defining a base surface, a bracket flag holder portion, and a plurality of spaced attachment slots extending through the body in spaced generally parallel relation to the base surface. Flexible fastening members each extend from a secured position within an attachment slot outwardly from the body. The fastening members are adapted to fixedly secure the body to a support surface and to be repeatedly quickly and easily attached to and detached from the support surface without damage to the support surface. A flag pole attaches to the flag holder portion to support a display flag. The flexible fastening members comprise flexible straps with mating fastening material on opposed sides of the straps. In another exemplary embodiment, suction cups extend outwardly from the base surface to securely engage a substantially flat support surface in removable relation.

15 Claims, 8 Drawing Sheets

(56) References Cited

U.S. PATENT DOCUMENTS

| | | | | |
|---|---|---|---|---|
| 5,769,474 | A * | 6/1998 | Moore | 294/210 |
| 6,138,882 | A * | 10/2000 | Buettner | 224/250 |
| 6,298,803 | B1 * | 10/2001 | Gregg | 116/28 R |
| 6,317,933 | B1 * | 11/2001 | Suenaga | 24/16 R |
| 6,367,182 | B1 * | 4/2002 | Olson, Jr. | 40/593 |
| 6,375,143 | B1 * | 4/2002 | Burns | 248/363 |
| D570,246 | S * | 6/2008 | Spicer | D11/166 |
| 7,587,796 | B1 * | 9/2009 | Schultz | 24/306 |
| 7,654,218 | B1 * | 2/2010 | Marlette | 116/173 |
| 7,810,265 | B2 * | 10/2010 | Beatty | 40/607.14 |
| 7,967,274 | B1 * | 6/2011 | Stallings et al. | 248/534 |
| 2007/0283875 | A1 * | 12/2007 | Durkin | 116/173 |
| 2011/0290171 | A1 * | 12/2011 | Brick et al. | 116/173 |
| 2014/0174334 | A1 * | 6/2014 | Tucker | 116/173 |

OTHER PUBLICATIONS 2003 promotional flyer of SSP Flags Inc., for Fixed Attach Flag Mount Base.

Side, bottom and top photos of Fixed Attach Flag Mount Base of SSP Flags Inc.

* cited by examiner

EASY ATTACH/DETACH FLAG MOUNT

PRIORITY

This application claims priority to U.S. Provisional Application 61/482,906, filed on May 5, 2011, which is incorporated herein by reference in its entirety.

BACKGROUND

1. Field of the Invention

This invention is directed to an improved mount for displaying flags on golf carts, all-terrain vehicles, and other moveable or stationery articles. Various flag mounts exist which may be secured to tubular support members of recreational and service vehicles and the like in a permanent or semi-permanent manner to permit the user to display service flags, patriotic flags, school flags or flags bearing any other indicia or colors which enable the user to associate or identify with any favored organization, cause or the like. Typically, such flag holders are mounted on a vehicle or other article by the owner or operator in at least a semi-permanent manner, with little need to remove or replace the flag holder for an extended period of time. However, there remains a need for an easy attach/detach flag mount which a user can quickly and temporarily attach and detach to and from a vehicle for intermittent displays of a flag for select occasions only, or can randomly mount the flag on one of several vehicles or one of a fleet of vehicles as desired or readily available, without scratching, marring or otherwise altering the vehicle support structure members to which the flag mount is selectively attached and detached.

SUMMARY

An exemplary embodiment of the present invention relates to a flag mounting bracket having a plurality of securely attached flexible mounting straps having opposite sides characterized by corresponding pair fastening materials, such as hook and loop fastening materials, or functionally similar flexible mating fastening materials, which are securely attached to the mounting bracket by fastening means including the engaged opposite sides of the straps and/or suitable adhesive material. In exemplary embodiments, the fastening pair straps may be quickly wrapped around a structural support tube or other structural vehicle or stationary member, and the body of the mounting bracket, such that the strap is wrapped back over itself with opposite sides of the strap firmly engaged with each other for sufficient areas of the opposed mating surfaces of the strap to securely engage the mount on the support tube or other member. In exemplary embodiments, the body of the mounting bracket includes a flag holder portion with a receptacle for engaging and maintaining a flag pole and flag in a desired display position.

Another exemplary embodiment of the present invention relates to such a bracket having a plurality of molded flexible plastic suction cups secured to the mounting bracket to facilitate attachment of the bracket to smooth surfaces such as the windshield, windows, or exterior body panels or surfaces of a golf carts, all-terrain vehicles, or other moveable or stationary articles, and easy detachment thereof.

These and other features and advantages of various exemplary embodiments of systems and methods according to this invention are described in, or are apparent from, the following detailed descriptions of various exemplary embodiments of various devices, structures and/or methods according to this invention.

BRIEF DESCRIPTION OF THE DRAWINGS

Various exemplary embodiments of the systems and methods according to this invention will be described in detail, with reference to the following figures, wherein.

DETAILED DESCRIPTION OF THE EXEMPLARY EMBODIMENTS

Figure 1:
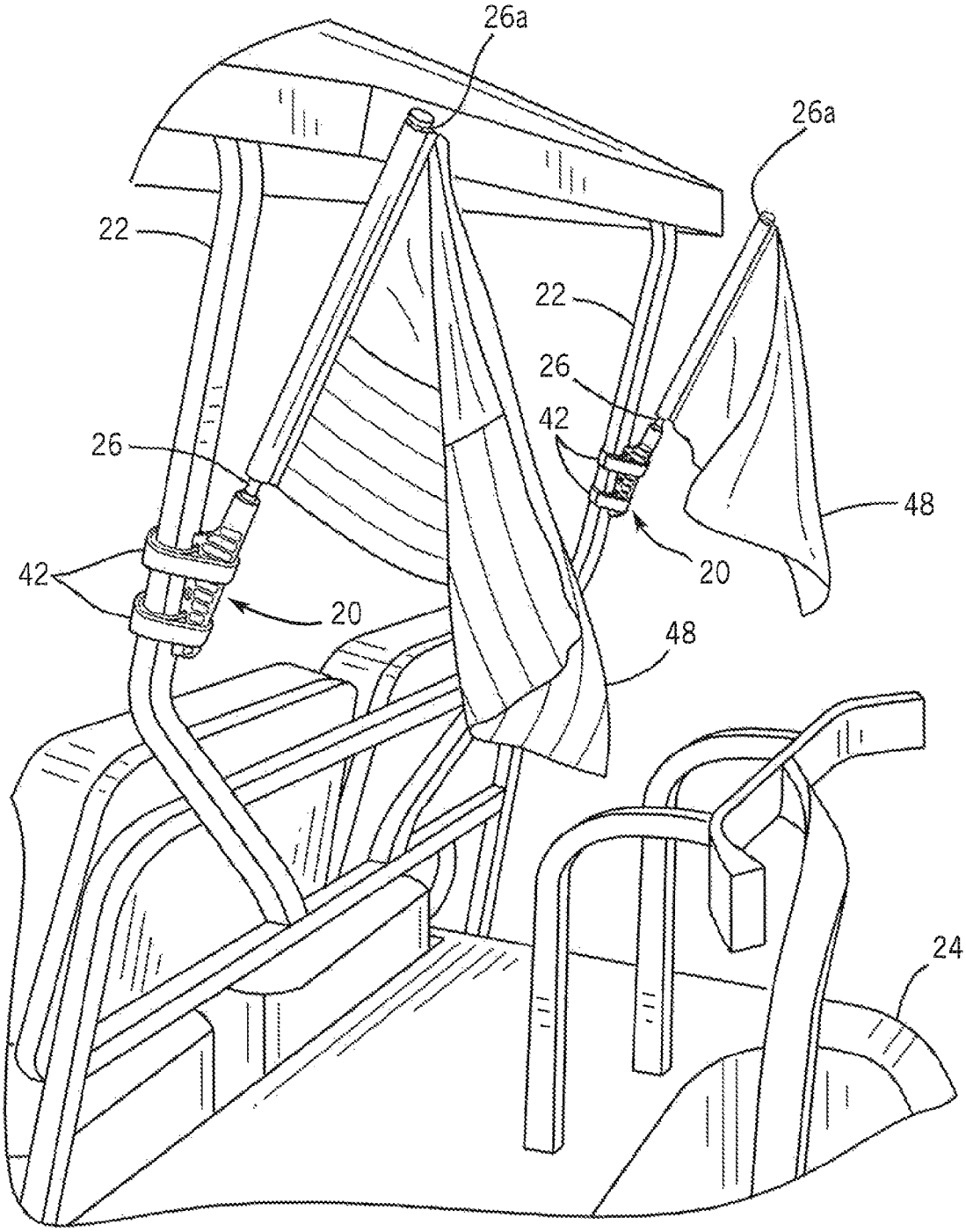
FIG. 1 is a perspective view illustratively showing a pair of flag mounts according to the present invention removably attached to the tubular support structure for the roof of a golf cart by flexible attachment straps to support flag poles displaying an American flag and a military service flag in an exemplary position on the golf cart.

FIG. 1 shows an exemplary embodiment of a pair of easy attach/detach flag mounts 20 of the present invention attached to a tubular roof support 22 of a typical golf cart 24. One of the attached flag mounts 20 supports a flag pole 26 to which an American flag is attached. The other supports a flag pole 26 flying a military service flag. The flag mounts 20 and flag poles 26 advantageously support the attached flags in an upright and respectful manner, allowing the flags to unfurl in full display in response to natural outdoor air movement, or movement of the vehicle 24 itself through the ambient air. It can be seen that the easy attach/detach flag mounts of the invention can be attached to any vehicle having suitably located structural tubing, including roof supports, roll bars, seat back supports, windshield supports, or the like. Such supports may be oriented vertically, horizontally or at an angle. The flag mounts 20 may also be advantageously and conveniently attached to generally upright tubular or solid support members for seat backs commonly found on chairs, and rockers, including folding chairs of a type frequently utilized by parade spectators who wish to honor their affiliations with patriotic, charitable, service, civic or educational organizations and causes.

Figure 2:
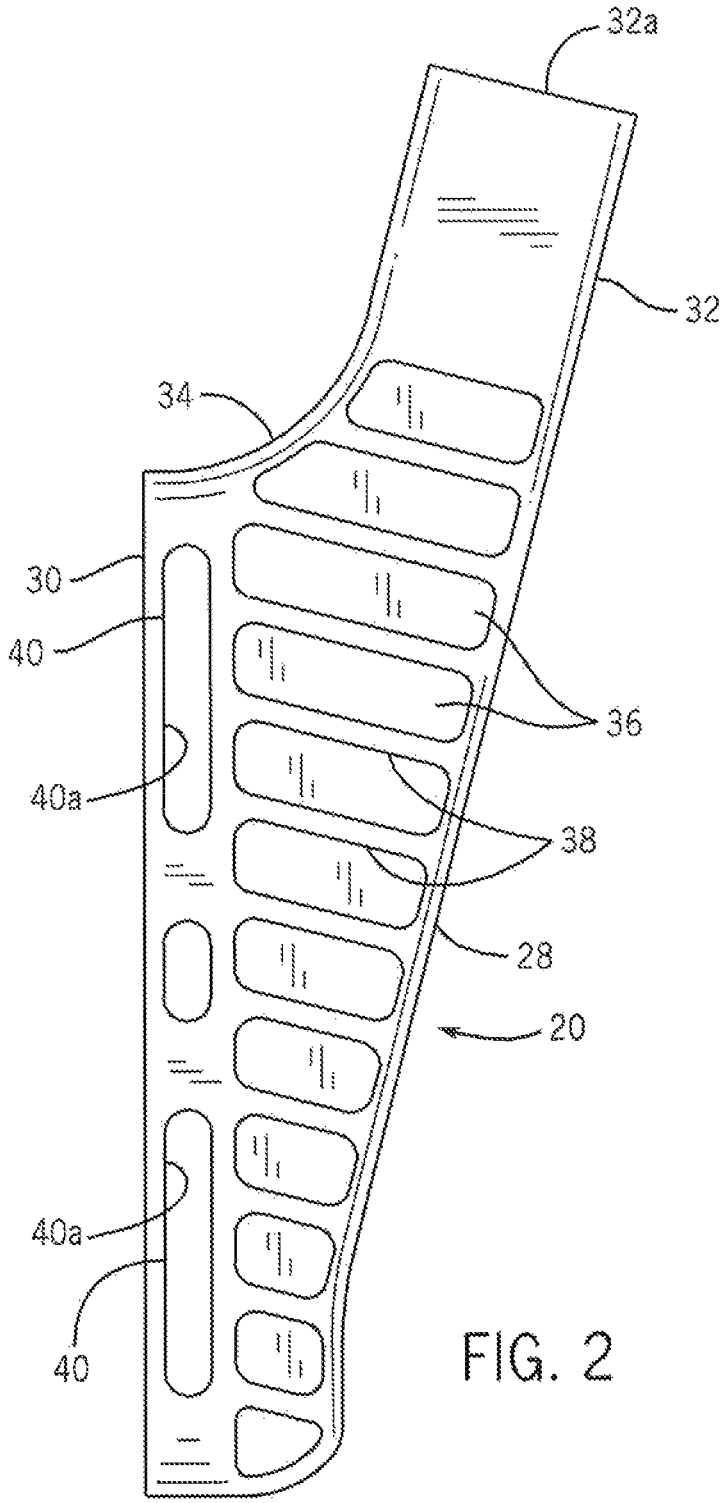
FIG. 2 is a side view drawing of the mounting bracket body of the flag mount of FIG. 1.

FIG. 2 is a side view of the mounting bracket 28 of the flag mount 20 of the invention. The mounting bracket may be formed of any solid wood, metal or rigid plastic material, with exemplary embodiments being formed of any injection molded plastic material, such as polypropylene. The illustrated exemplary embodiment of the mounting bracket is characterized by a relatively flat base 30, and a flag holder portion 32 having an axis extending at a selected angle to the base 30. In an exemplary embodiment the body 34 may have a plurality of recesses 36 which in turn may partially define ribs 38 separating such recesses 36. The recesses 36 and ribs 38 may be formed in any desired design or array, but material savings and material strength will be normal engineering considerations. Two or more attachment slots 40 are advantageously located in spaced generally parallel relation to the base 30 to accommodate flexible attachment straps 42, as shown in FIGS. 3 and 4, and described below.

The attachment straps 42 have opposed surfaces 44 and 46 which are each respectively comprised of one of a corresponding pair of mating fastening materials. In an exemplary embodiment, the selected mating fastening materials are of the "hook and loop" type construction marketed under the Velcro® brand. Alternatively, the corresponding mating materials may be selected from various similar mating material fastener pairs which are now or may in the future become available commercially. Such mating materials may be of complementary materials of different construction, as is the case with various "hook and loop" or other complementary but different mating material pairs, or of mating materials of identical construction which might be characterized as "hook and hook" construction, wherein the irregular "hook" or "barbed" structure of the material is such that the hooks or barbs of the material will quite strongly "lock" together when two such similar irregular surfaces are pressed together in overlapping relation. An example of one such commercially available material is marketed by RadioShack® as Superlock™ Fasteners. In either case, such materials may be selected which have a desired tensile disengagement strength and separation strength which will effectively retain the flag mounts of the invention on typical tubular golf cart support structures or all-terrain vehicle roll bar supports under most normal conditions of use and operation.

In the exemplary embodiments of the accompanying FIGS. 1-6, the illustrated flexible attachment straps are Velcro® brand straps having a "hook" type surface 44 on one side of the strap 42, and a "loop" type surface 46 on the other side of the strap. For case and clarity of description, the sides of the strap 42 will be referred to simply as hook side 44 and loop side 46. In an exemplary embodiment, the straps may have a substantial width of approximately % inch, and a length of approximately 12 inches long, which dimensions may be varied to best suit the application.

Figure 3:
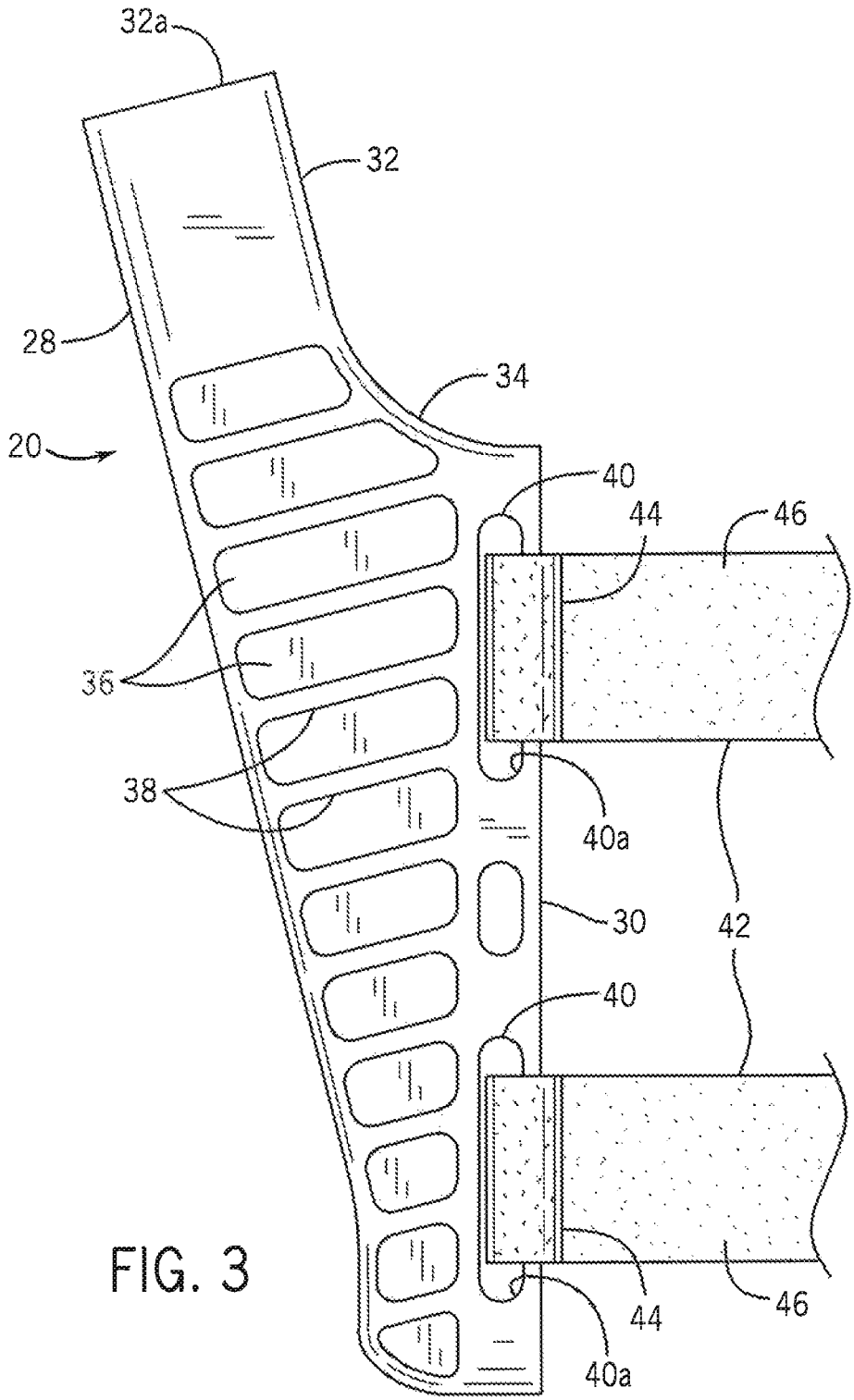
FIG. 3 is a side view of a flag mount according to the present invention wherein each of the opposite sides of each attachment strap are characterized by a different one of a complimentary pair of hook and loop fastening surfaces, and each strap is secured to one of two bracket attachment slots formed in the body of the mounting bracket of the flag mount.
Figure 4:
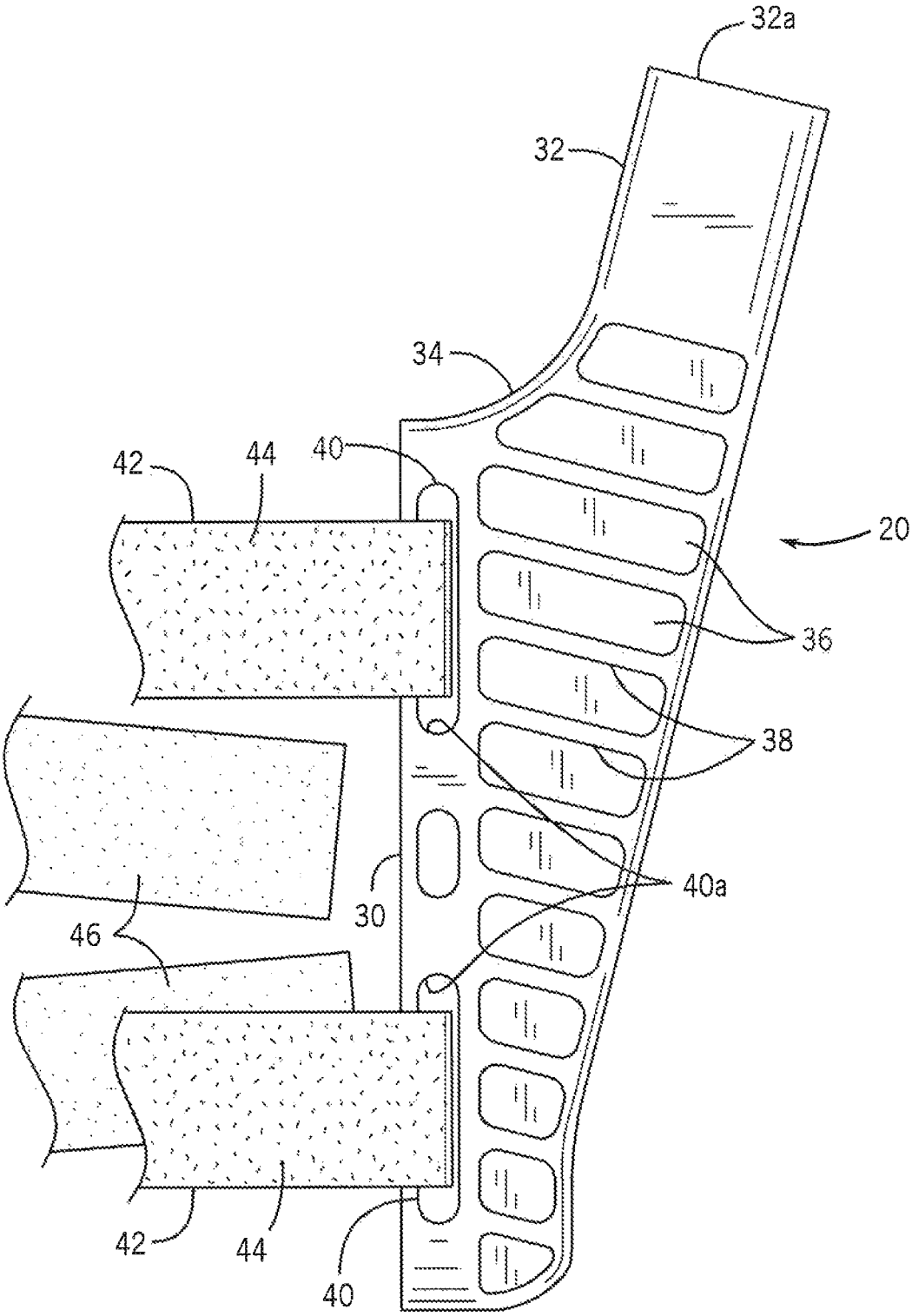
FIG. 4 is a side view of the mounting bracket, taken from the opposite side of the bracket of FIG. 3, showing the straps secured within the attachment slots of the bracket.

In the embodiments of FIGS. 3 and 4 it can be seen, and it is herein further disclosed, that the straps 42 may be advantageously secured to the mounting bracket 28 in the following manner. One end (the fastened end) of each strap 42 may be attached to an attachment surface 40*a* of one of the respective attachment slots 40 of the bracket 28. The attachment surfaces 40*a* can be seen from FIG. 2 to be generally flat and elongated within the body 34 of the mounting bracket 28 in proximity to the bracket base 30 to provide a substantial attachment surface for the fastened end of each strap 42. Typically, the bracket body 34 may have a thickness of approximately ¾ inch, and the attachment slots 40 will each have a length in excess of ¾ inch to accommodate at least a strap 42 having a width of inch as previously described. Accordingly, the area of direct attachment of the strap 42 to the slot attachment surface 40*a* may be about ¾ inch square. The strength of the attachment of the sides of the strap to each other will be increased by an increase in the width of the strap and also by an increase in the length of the area of attachment of the opposed sides.

In an exemplary embodiment, the loop side 46 of the strap 42 is glued to the attachment surface 40*a* of the bracket body by a suitable hot glue or other adhesive material which may be selected to readily bond with both the material of the bracket 28 and the surface of the strap 42. The loop side 46 of the strap 42 may then be wrapped tightly around the base 30 of the bracket 28 and back through the attachment slot 40 such that the loop side 46 is tightly mated within the slot 40 with the hook side 44 of the previously fastened end of the strap 42 to clinch the wrapped portion of the strap in secure mating engagement of the cooperating hook and loop surfaces to further secure the fastened end of the strap 42 to the bracket 28. The intermediate portions and free distal ends of the flexible straps 42 then extend outwardly from the bracket 28 for further use as will be further described below. However, it should be understood that, alternatively, the straps 42 may be attached with the hook side 44 of the strap glued to the attachment surface 40*a*, and the hook side of the strap similarly tightly wrapped around the base 30 and back through the attachment slot 40 to tightly clinch the hook side with the adjacent portion of the strap loop side 44 to secure the equivalent mating engagement of the cooperating oppositely oriented hook and loop strap surfaces. Either orientation of the strap side surfaces may be selected as desired for the intended use of the flag mount 20.

Figure 5:
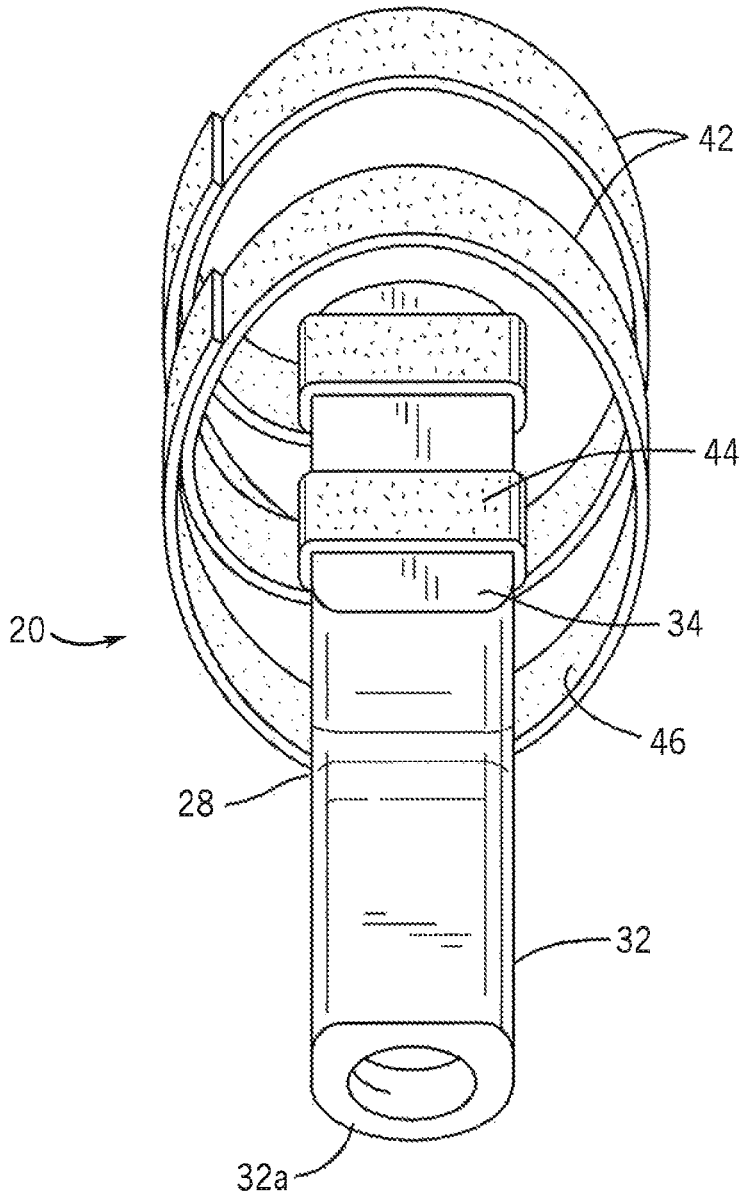
FIG. 5 is a top end perspective view of the mounting bracket of FIGS. 3 and 4, showing each of the attachment straps extending transversely across a bearing surface of the mounting bracket body, and looped around a space above the body and beneath the body itself, with the inward facing sides of the distal end portion of each strap engaged in interlocked mating relation with the outward surface of an intermediate portion of the looped strap, respectively.
Figure 6:
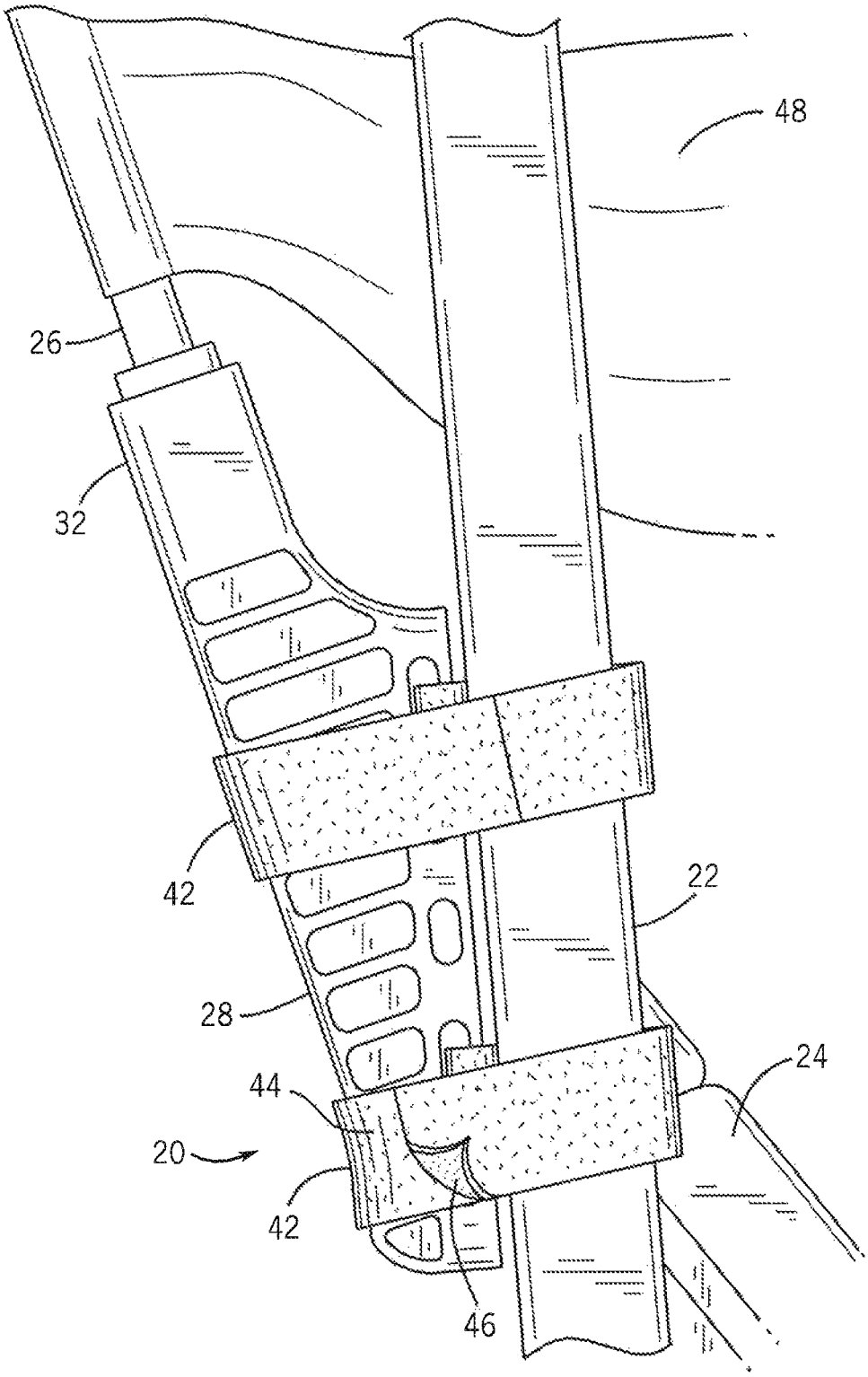
FIG. 6 is an opposite side view of one of the mounting brackets shown in FIG. 1, more closely illustrating the mounting bracket of the flag mount as it is secured to a rear surface of a roof support tube of a golf cart by the mounting bracket attachment straps tightly wrapped around the mounting bracket body and the support tube in mating engagement.

FIG. 5 is a perspective view of the bracket 28 with the flexible straps 42 wrapped in a loop over the bracket base 30, and over the tightly wrapped and clinched portions of the straps which have been previously engaged as described and further shown in FIG. 5. The looped portions of the straps 42 in FIG. 5 illustrate the ability of the straps to encompass a vehicle or stationary support member positioned adjacent to the bracket base, as shown in FIGS. 1 and 6. The straps are selected to be of sufficient length to easily be wrapped and tightened around the tubular supports of the vehicles shown in FIGS. 1 and 6, as well as around larger or smaller girth vehicle roll bars, chair frame members, or other suitable elongated support members.

FIGS. 5 and 6 clearly illustrate the structure and manner by which the flag mount brackets 28 may be easily attached and detached from the roof support tubes 22 of a golf cart 24, or any other generally vertical, horizontal or inclined tubular or solid spindle type support. The user may easily attach the flag mount bracket 28 to the illustrated support tube 22 by positioning the bracket adjacent to the tube at a desired position, and tightly wrapping or whipping the flexible straps 42 in a looped manner around the tube 22 and back around the bracket body 34, and thence back over the outer portion of the strap 42 itself, to engage the inwardly facing loop side 46 of the illustrated distal end portion of the strap 42 against the outwardly facing hook side 44 of the looped intermediate portion of the strap 42, and tightly pressing the engaged opposite surfaces of the strap 42 together to lock the complementary surfaces in firm engagement to thereby firmly secure the flag mount bracket 28 in fixed position on the support member 22. The term "distal end portion" of the strap 42 is intended to refer to whatever length of the free end of the strap overlies and is engaged in mating relation with an intermediate "looped" portion of the strap 42 in any flag holder installation. It can be seen from FIGS. 1 and 6, and further appreciated from FIG. 5, that the exemplary 12 inch flexible straps shown will provide an extended length of distal end portion engagement of the mating opposite side complementary fastening surfaces to secure the fully strap-encircled mounting bracket 28 on the likewise encircled support member 22 to retain the flag mount on a vehicle support member during both normal over the road or unpaved terrain motion of the vehicle, as well as during any wind activity which might occur under conditions suitable for golf, parades or other outdoor recreational activities. In FIG. 6 the lower corner of the distal end of the lower strap 42 of the exemplary embodiment has been turned open to illustrate the relationship of the hook side 44 and loop side 46 of the strap 42.

Conversely, the flag mount 20 may be easily detached at the end of the subject activity by simply pulling on the distal ends of the straps 42 to progressively free the mated complementary fastening surfaces of the overlapping sides of the tape and unwrapping the straps from around the mounting bracket 28 and the support member 22, to freely remove the flag mount.

FIGS. 1 and 6 illustrate the manner in which the flag mount 20 and flag poles 26 advantageously support the display flags 48. FIG. 5 reveals that the terminal end of the exemplary flag holder portion 32 of the flag mount bracket body 34 may be tubular and internally threaded 32*a* or otherwise designed to receive and retain a cooperatively threaded or otherwise designed end of the flag pole 26 (not shown) to fixedly retain the flag pole securely within the flag holder during all conditions of intended reasonable use. The flag pole 26 may also have a retainer of known or future design, such as a removable threaded cap or snap-on O-ring 26*a*, or the like, to retain the flag on the pole during use, and to permit flags of different designs or significance to be installed on the flag pole as desired.

The improved easy attach/detach flag mount of the invention is equally convenient for golf cart owners or renters to readily attach and detach appropriate flags to their golf carts for display as desired on selected occasions more easily than it would be to attach their golf bags to the carts. Similarly, golf course owners/operators with fleets of carts for patron use may randomly designate any cart or carts from the fleet for use by rangers, marshals, service and maintenance personnel, officials or observers, and readily provide them with official flags to inform golfers, spectators or other officials of their authority, responsibilities or available services. At the end of any such assignment or responsibility, the flag holder of the invention may be easily detached from the cart or other service vehicle, and the vehicle can be returned to the fleet, unmarred, for general use by other patrons.

Figure 7:
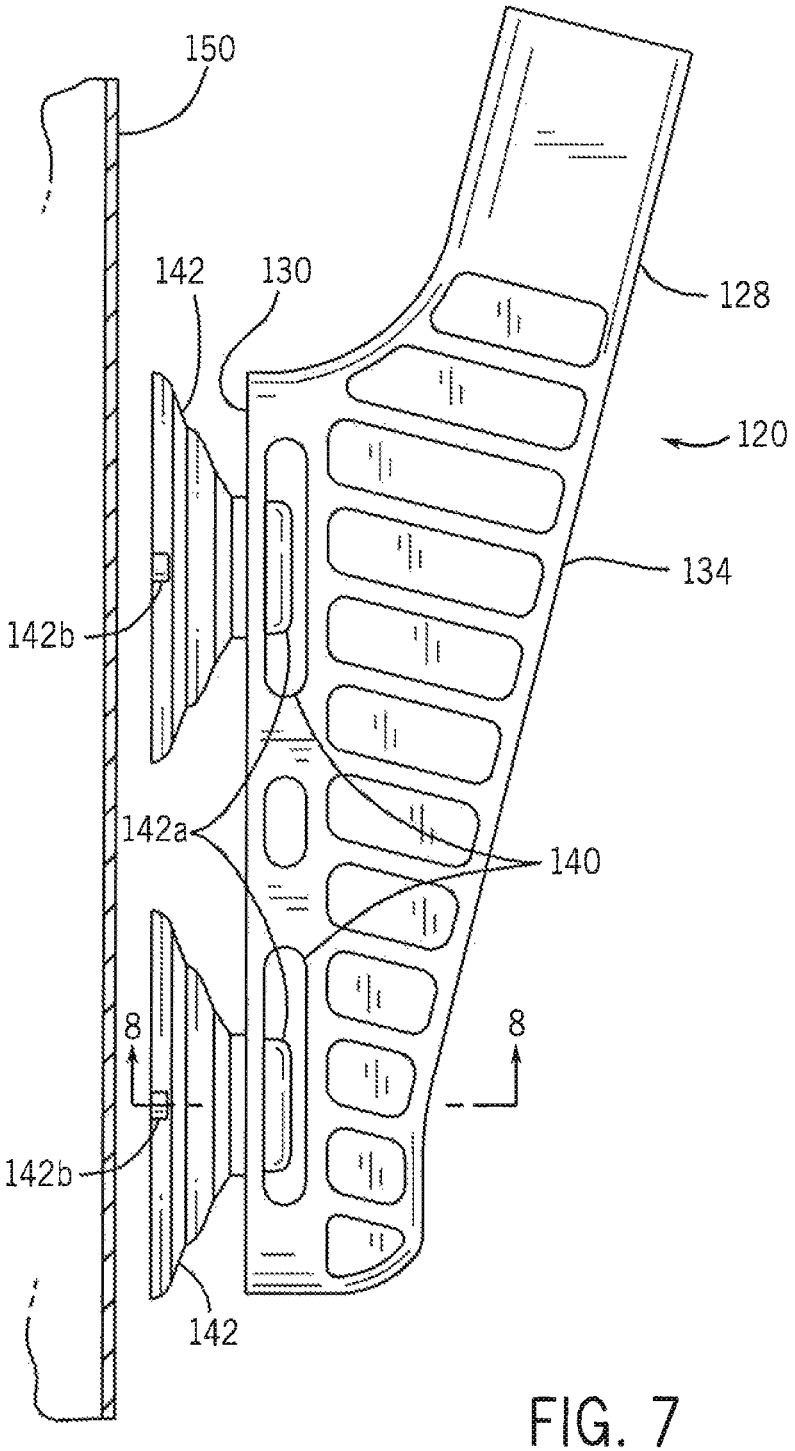
FIG. 7 is a side view of an exemplary mounting bracket body wherein plastic suction cups have been engaged in the bracket attachment slots for adaptation of the flag mounting bracket for easy ON/OFF attachment of the bracket to smooth vehicle window and exterior body surfaces.
Figure 8:
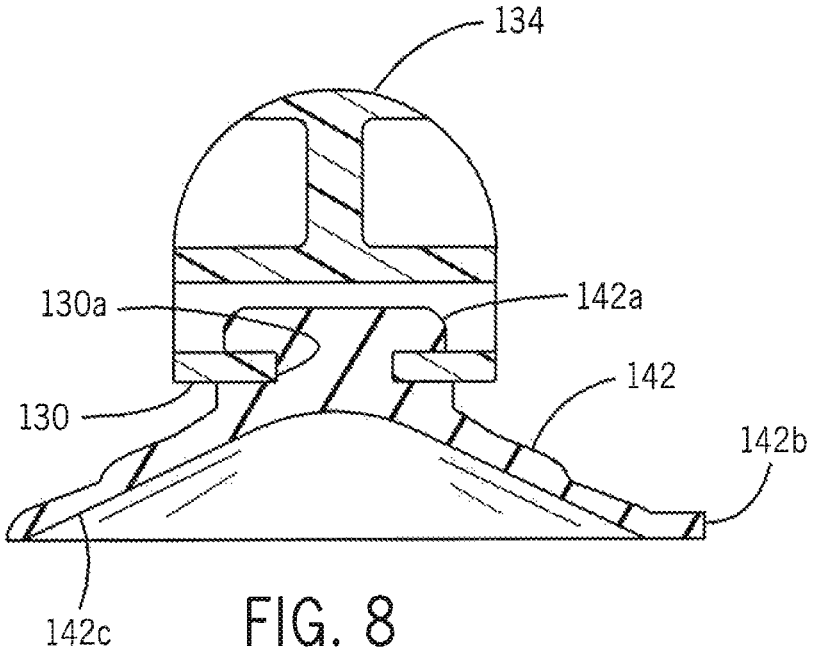
FIG. 8 is a section view taken along Section line 8-8 of FIG. 7.
Figure 9:
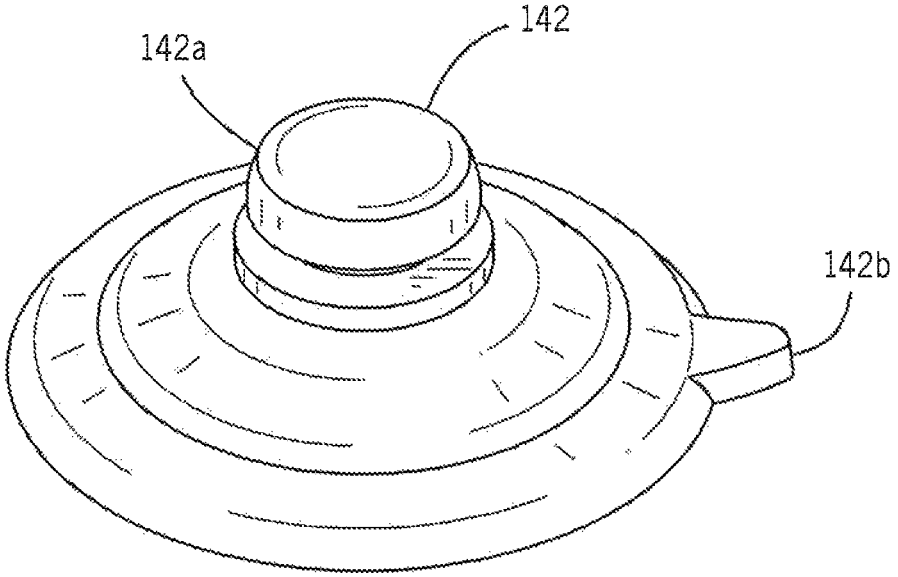
FIG. 9 is a perspective view of a flexible suction cup attachment member.

FIG. 7 shows an exemplary embodiment in which an alternative flag mount 120 is provided having a mounting bracket 128 fitted with a plurality of spaced, flexible plastic suction cups 142 adapted to fixedly but removably engage the mounting bracket 128 on substantially smooth and flat surfaces, such as windshields and exterior body panels of standard or custom golf carts or all-terrain or other recreational or special purpose vehicles, and other indoor or outdoor, fixed or movable, suitable flat surface venues for displaying flags of any kind or for any purpose. The flexible suction cups 142 of flag mount 120 are attached to a bracket body 134 which is similar to the previously described bracket body 34, except that the flat base 130 has a hole or slot 130A, shown in FIG. 8, for receiving the "mushroom" head of the illustrated Medium Cup with Mushroom Head manufactured by Adams Mfg. of Portersville, Pa., more specifically shown in FIG. 9. After being inserted through the hole, which opens into one of the bracket attachment slots 140, the mushroom head 142A expands into the wider opening of the associated slot 140 to retain the cup 142 in the hole, and the bracket body 134 positioned on the surface to which the cup may be firmly attached. Other suitable suction cups from Adams and other sources may be utilized as advantageously desired.

FIG. 7 shows the bracket 128 and suction cups 142 in "exploded" position from a simulated windshield or window surface 150. The bracket 128 may be firmly secured to the glass surface 150 by pressing the cups tightly against the glass surface 150 to dispel substantially all of the air between the cup 142 and the glass surface 150. The atmospheric air pressure then retains the cups 142 against the glass 150, and the bracket 128 and an attached flag pole 26 (not shown in FIG. 7) in position under normal expected atmospheric conditions. Conversely, the cups 142 and mount bracket 128 are easily disengaged from the glass surface 150 by pulling cup nubs 142B away from the glass surface to admit air between the cup suction surface 142C and the engaged glass surface 150 and easily remove the flag mount 120 from the glass support surface 150.

Although the exemplary embodiment of the flag mount 120 has been described with respect to a particular mounting bracket 128 and a particularly advantageous suction cup model and size, it should be understood that both the brackets 28, 128, and the suction cups 142, may be manufactured in different sizes, models, shapes and materials, and the cups may be attached to the bracket in different manners, so long as the cups and the bracket are securely attached together, and the cup perimeters are easily accessible to the user to facilitate breaking of the vacuum seal between the cups and the supporting surface for easy removal of the cups and bracket.

The flag mount 120 thus enables the user to utilize a mounting bracket 128 of this invention for easy ON/OFF attachment of a flag to a smooth, flat or slightly curved surface, in the absence of a suitable structural post, tube or spindle structure or the like for which the attachment straps 42 of flag mount 20 are particularly well suited. It will also be apparent from the foregoing description that the mounting bracket 128 of the invention may be provided with both flexible attachment straps 42 and suction cups 142 to permit attachment of either the straps or the suction cups to the bracket depending upon the vehicle or support structure to which the user finds most advantageous and desirable to utilize for displaying his flag(s).

While this invention has been described in conjunction with the exemplary embodiments outlined above, various alternatives, modifications, variations, improvements and/or substantial equivalents, whether known or that are or may be presently foreseen, may become apparent to those having at least ordinary skill in the art. Accordingly, the exemplary embodiments of the invention, as set forth above, are intended to be illustrative, not limiting. Various changes may be made without departing from the spirit of the invention. Therefore, the invention is intended to embrace all known or earlier developed alternatives, modifications, variations, improvements and/or substantial equivalents.

What is claimed is:

1. A flag mount for easy attachment and detachment of a display flag to and from a support surface, comprising:

a flag mount bracket having a body base surface and a flag holder portion having an axis extending at an inclined angle to the base surface, the body base having one or more slots sized and configured to accept one or more overlapping flexible attachment straps and having one or more holes perpendicular to the slots sized and configured to accept one or more suction cups;

a plurality of flexible attachment members engaging the body in spaced relation, each attachment member being adapted to extend from a secured position—on the body to flexibly engage a support surface in fixed relation, each attachment member being detachable from the support surface by physical disengagement of—the flexible attachment member from the support surface without damage to the support surface or the flexible attachment member,—whereby—the body may be repeatedly quickly and easily attached to and detached from the support surface for use and non-use respectively; and a flag pole adapted to be removably engagable with the flag holder portion for supporting a display flag at an angle to the support surface when the body is attached to the support surface.

2. The flag mount of claim 1, wherein the flag pole and the flag holder portion are adapted to be threadedly engaged, and wherein the flag is adapted to be removably engaged on the flag pole.

3. The flag mount of claim 1, wherein the spaced flexible attachment members comprise flexible straps having mating fastening material on opposed surfaces of the straps to permit the straps to each be flexibly secured around a support member and retained in securing position by adherence of the fastening material on one side of the strap to the mating fastening material on an opposite overlapped side of the strap.

4. The flag mount of claim 3 wherein the mating fastening materials on opposite sides of the flexible attachment members are respectively selected from the group of fastening materials including hook and loop fasteners and hook and hook type fasteners.

5. The flag mount of claim 1 wherein the spaced flexible fastening members comprise flexible suction cups each adapted to securely engage a substantially flat support surface in a substantially vacuum relationship and retain their engagement with the support surface during normal display conditions for the flag mount.

6. The flag mount of claim 5 wherein the flexible suction cups are molded from polyvinyl chloride material.

7. The flag mount of claim 5 wherein the suction cups have an attached mushroom shaped head, and wherein the holes provided on the—bracket base include a plurality of spaced holes, each hole extending from the outer surface of the base to an attachment slot, and wherein the base holes are sized smaller than the diameter of the mushroom heads to permit the mushroom heads to each be flexibly compressed and inserted through a hole into the interior of the attachment slot, wherein the mushroom heads are adapted to extend to normal diameter and prevent the head from being withdrawn from the bracket body hole during normal use of the bracket.

8. The flag mount of claim 5 wherein at least one of the suction cups has an access nub extending from the peripheral edge of the cup for facilitating disengagement of the cup from a supporting surface by gripping the nub and pulling it in a direction away from the supporting surface.

9. A flag mount for easy attachment and detachment of a display flag to and from a support surface, comprising:

a flag mount bracket having a body base surface and a flag holder portion having an axis extending at an inclined angle to the base surface;

a plurality of spaced attachment slots extending through the body in spaced relation to the base surface;

a plurality of flexible attachment strap members engaging the body in spaced relation, each attachment strap being adapted to extend from a secured position within an attachment slot outwardly from the body to flexibly engage a support surface in fixed relation, each attachment strap member being detachable from the support surface by physical disengagement of the flexible attachment strap member from the support surface without damage to the support surface or the flexible attachment member, whereby the body may be repeatedly quickly and easily attached to and detached from the support surface for display use and non-use respectively, wherein the flexible attachment strap members have mating fastening material on opposed surfaces of the straps to permit the opposed surfaces of the straps to be secured to each other by adherence of the fastening material on one side of the strap to the mating fastening material on the opposite overlapped side of the strap, wherein the straps may each be connected to the bracket body by an end of the strap extending through an attachment slot at least one pass and around the exterior surface of the bracket base such that a length of a strap surface at least about equal to the width of the bracket body is overlapped by at least an equal length of the opposite surface of the strap to secure the strap to the bracket in secure relation; and further wherein each strap member is adapted to be extended outwardly from the bracket body and around a structural element comprising a support surface and thence back around the bracket body and an opposite side of the strap in overlapping relation to secure the bracket body in close fixed proximity to the support surface and position the bracket in a desired flag display position; and whereby the bracket may be disengaged from the support surface by physically separating the overlapped mating surfaces of the flexible straps to disengage the straps from and around the support member and permit the bracket body to be separated and removed from the supporting surface; and a flag vole adapted to be removably engageable within the flag holder portion for supporting a display flag at an angle to the support surface when the body is attached to the support surface.

10. The flag mount of claim 9 wherein a side of an attachment strap may be adhesively glued to a portion of the bracket body to additionally secure the strap to the body.

11. The flag mount of claim 9 wherein the flexible strap members have a significant width to provide mating surfaces of substantial width and provide for secure attachment of the bracket to the support surface.

12. A flag mount for easy attachment and detachment of a display flag to and from a support surface, comprising:

a flag mount bracket having a body base surface and a flag holder portion having an axis extending at an inclined angle to the base surface;

one or more spaced attachment slots sized to accept one or more overlapping flexible attachment straps extending through the body and spaced in generally parallel relation to the base surface;

one or more attachment holes perpendicular to the slots and sized to accept one or more suction cups;

a plurality of flexible attachment members engaging the body in spaced relation, each attachment member comprising a suction cup adapted to extend from a secured position within an attachment slot outwardly through the hole in the body to flexibly engage a support surface in fixed relation, each suction cup being detachable from the support surface by physical disengagement of the flexible attachment member from the support surface without damage to the support surface or the suction cup, whereby the body may be repeatedly quickly and easily attached to and detached from the support surface for use and non-use respectively; and a flag pole adapted to be removably engagable within the flag holder portion for supporting a display flag at an angle to the support surface when the body is attached to the support surface.

13. The flag mount of claim 12 wherein the flexible suction cups are molded from polyvinyl chloride material.

14. The flag mount of claim 12 wherein the suction cups have an attached mushroom shaped head, and wherein the bracket base has a plurality of spaced holes, each hole extending from the outer surface of the base to an attachment slot, and wherein the base holes are sized smaller than the diameter of the mushroom heads to permit the mushroom heads to each be flexibly compressed and inserted through a hole into the interior of the attachment slot, wherein the mushroom heads are adapted to extend to normal diameter and prevent the head from being withdrawn from the bracket body hole during normal use of the bracket.

15. The flag mount of claim 12, wherein at least one of the suction cups has an access nub extending from the peripheral edge of the cup for facilitating disengagement of the cup from a supporting surface by gripping the nub and pulling it in a direction away from the supporting surface.

* * * * *

UNITED STATES PATENT AND TRADEMARK OFFICE

CERTIFICATE OF CORRECTION

PATENT NO. : 9,087,462 B1
APPLICATION NO. : 13/463094
DATED : July 21, 2015
INVENTOR(S) : Gallus It is certified that error appears in the above-identified patent and that said Letters Patent is hereby corrected as shown below:

Title Page, in Item (56), under "FOREIGN PATENT DOCUMENTS", in Column 2, Line 1, delete "G06F 17/00" and insert -- G09F 17/00 --, therefor.

Specification

In Column 3, Line 55, delete "case" and insert -- ease --, therefor.

In Column 3, Line 58, delete "%" and insert -- ¾ --, therefor.

In Column 4, Line 7, delete "of inch" and insert -- of ¾ inch --, therefor.

Claims

In Column 8, Line 39, in Claim 9, delete "vole" and insert -- pole --, therefor.

Signed and Sealed this
Twenty-second Day of March, 2016

Michelle K. Lee

Michelle K. Lee
*Director of the United States Patent and Trademark Office*